United States Patent [19]

Theurer et al.

[11] 3,939,774

[45] Feb. 24, 1976

[54] APPARATUS FOR BONDING TOGETHER PIECES OF TRACK BALLAST

[75] Inventors: Josef Theurer; Klaus Riessberger, both of Vienna, Austria

[73] Assignee: Franz Plasser Bahnbaumaschinen-Industriegesellschaft m.b.H., Vienna, Austria

[22] Filed: Jan. 10, 1975

[21] Appl. No.: 539,947

[30] Foreign Application Priority Data

Jan. 17, 1974 Austria ..... 378/74

[52] U.S. Cl. ..... 104/11

[51] Int. Cl.[2] ..... E01B 27/16

[58] Field of Search..... 104/1 R, 10, 11, 12; 238/1, 2, 7, 8, 9; 404/75, 76; 91/367, 453

[56] References Cited

UNITED STATES PATENTS

| | | | |
|---|---|---|---|
| 1,041,878 | 10/1912 | Royal | 104/11 |
| 2,669,942 | 2/1954 | Scheuchzer | 104/11 |
| 3,656,690 | 4/1972 | Hanig | 104/11 |

FOREIGN PATENTS OR APPLICATIONS

| | | | |
|---|---|---|---|
| 689,332 | 3/1953 | United Kingdom | 104/11 |

*Primary Examiner*—Robert J. Spar
*Assistant Examiner*—Randolph A. Reese
*Attorney, Agent, or Firm*—Kurt Kelman

[57] ABSTRACT

While a tamping unit with tamping tools for tamping track ballast is lowered to immerse the tamping tools in the ballast and to tamp the same, a metered amount of a liquid bonding medium is delivered to and through internal conduits in the tamping tools and ejected through an opening under pressure thereby to bond together pieces of ballast coated by the ejected bonding medium. The commencement and termination of the bonding medium delivery is controlled in response to the depth of immersion of the tamping tools in the ballast.

5 Claims, 4 Drawing Figures

APPARATUS FOR BONDING TOGETHER PIECES OF TRACK BALLAST

Figure 1:
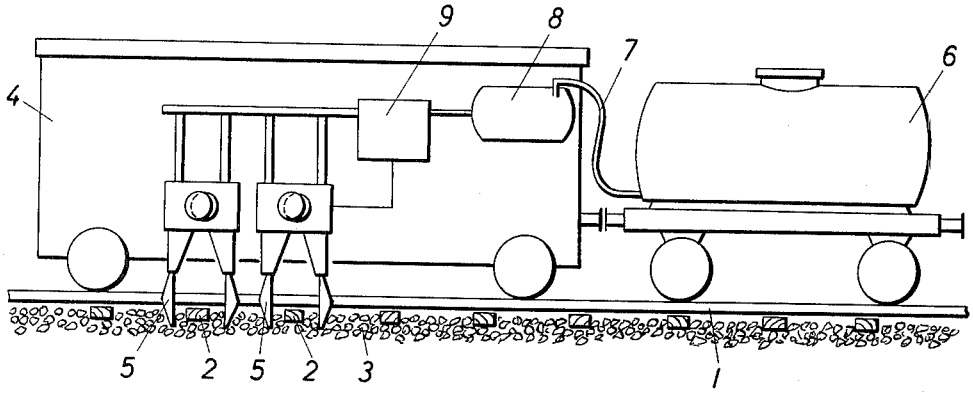

The present invention relates to improvements in an apparatus for bonding together pieces of ballast forming the bed of a track consisting of ties and rails fastened to the ties, the ballast bed having regions supporting the ties and laterally adjacent the tie ends.

It is common practice to tamp the ballast in at least one of the regions to provide a firmer support for the track ties so that the track will move as little as possible under the load of trains traveling thereover. Mobile track tamping machines have been used for this purpose. The constant vibrations to which the moving trains subject the track cause the tamped ballast to become looser in the course of time and this, in turn, causes a dislocation of the track supported thereon. These track movements out of its correct position result in a less comfortable ride and also impose serious limitations to the speed with which trains may safely move over such dislocated tracks. All of these phenomena are reinforced under recently introduced high train speeds and under heavy train loads.

Where the track is designed for trains running at a speed in excess of 200 km/hour, the track geometry requires very high accuracy and this, in turn, has made frequent track renewal and maintenance operations necessary, particularly since such high-speed track usually also experience a high density of traffic.

Recently, it has been proposed to increase the firmness of the track support offered by the ballast bed by bonding together pieces of the ballast so as to produce a coherent track bed, and the chemical industry has provided a number of liquid bonding media for this purpose. A number of track sections have been experimentally treated in this manner for test purposes. In all of these tests, the chemical bonding media have been simply sprayed onto the ballast bed so that only the surface pieces of ballast are bonded together. This is only of limited use since the regions of the ballast bed which are subjected to the highest loads are those which support the ties, i.e. the ballast pieces resting below the ties and which can, therefore, not be reached when the ballast bed is sprayed with the liquid bonding medium.

It has been proposed to provide the tamping tools of a mobile tamping machine with an internal conduit ending in an opening for ejecting a liquid bonding medium passing through the conduit under pressure against the ballast bed. Since the bonding media are relatively expensive, their economical utilization is of considerable commercial importance. Furthermore, since the amount of bonding medium has a substantial influence on the quality of the bonding, an accurate control of the ejected amount of bonding medium is essential.

It is accordingly a primary object of this invention to provide an apparatus assuring an effective and economical bonding together of pieces of ballast.

This is accomplished in accordance with the invention by tamping the ballast with an immersed tamping tool, delivering a metered amount of a liquid bonding medium under pressure to and through an internal conduit of the tamping tool to eject it through the opening and thereby to bond together pieces of the ballast coated by the ejected bonding medium, and controlling the commencement and termination of the bonding medium delivery to the conduit in response to the depth of immersion of the tamping tool in the ballast.

Since any one tamping step involves a given and known volume of ballast, it is possible to predetermine exactly the amount of bonding medium needed to obtain an optimum bonding effect for this known volume of ballast, and to meter a corresponding amount during the tamping. Furthermore, it is important that ejection of the bonding medium commences only when the tamping tool has been immersed to a given depth in the ballast and is terminated before the tamping tool has been withdrawn from the ballast.

The apparatus of the present invention comprises a mobile track tamping machine having a frame mounted for mobility on the track and a ballast tamping tool having an internal conduit ending in an opening for ejecting a liquid passing through the conduit under pressure. A vertically movable carrier for the tamping tool is mounted on the frame for moving the tamping tool between an upper position out of engagement with the ballast and a lower position wherein the tamping tool is immersed in the ballast for tamping thereof. Conduit means leads from a storage container for a liquid bonding medium to the internal conduit of the ballast tamping tool for delivering the liquid bonding medium from the container to the internal conduit and a metering means for the liquid bonding medium is arranged in the conduit means. The metering means consists of a cylinder-and-piston device with an adjustable piston stroke and a pressure fluid operated drive moves the piston of the device in response to the vertical movement of the tamping tool carrier.

Figure 3:
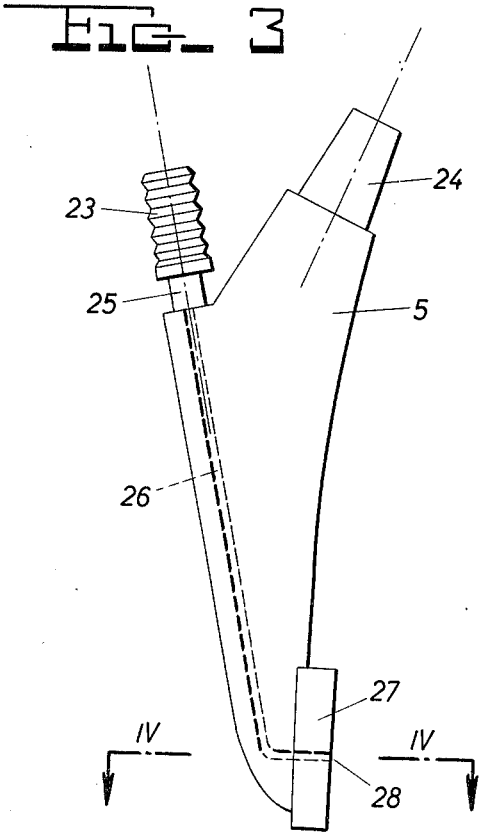
Figure 4:
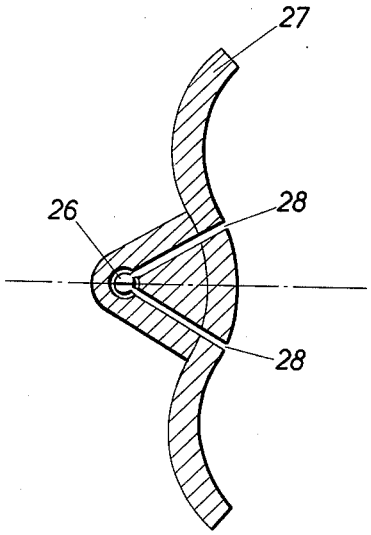
Figure 2:
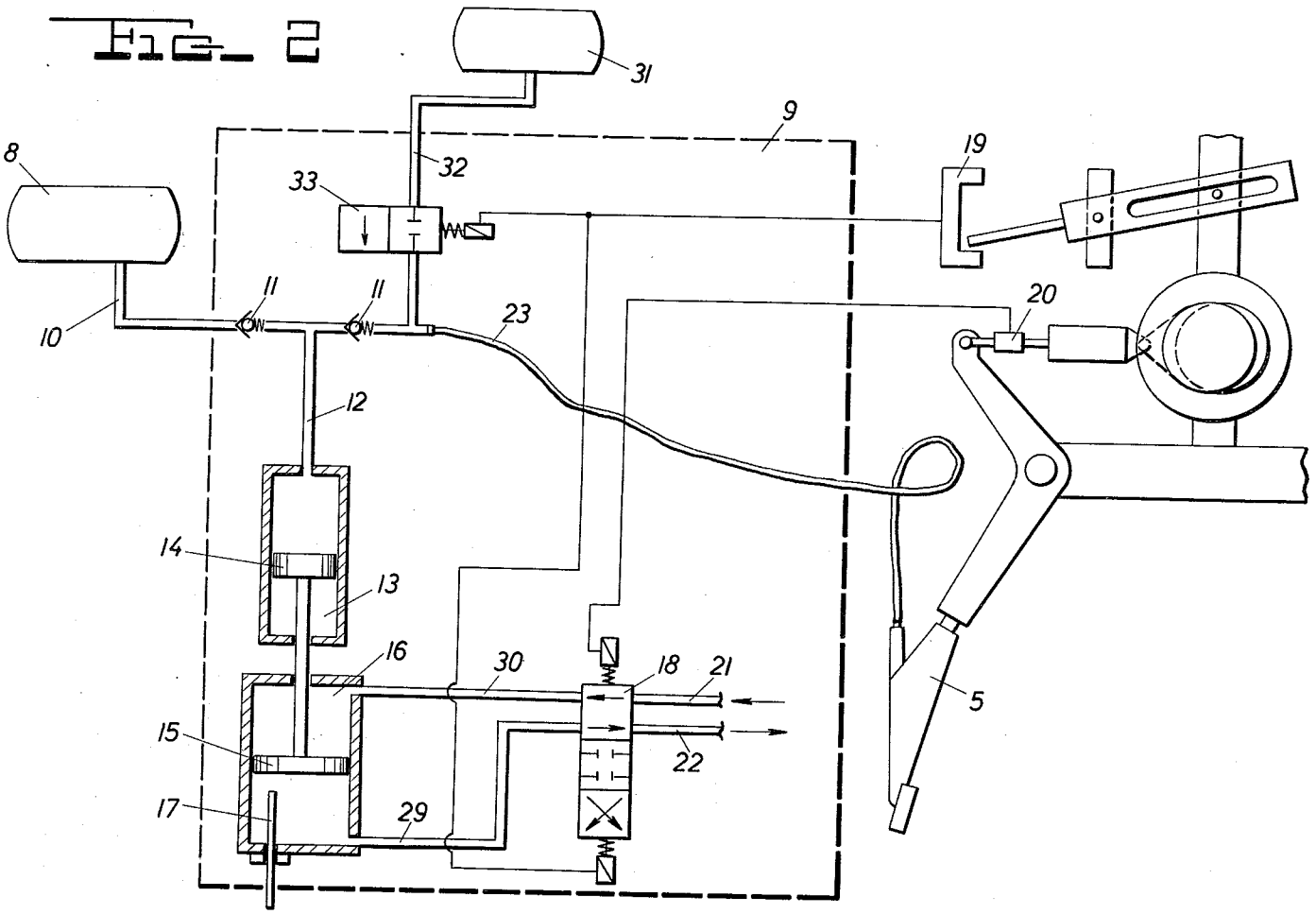

The above and other objects, advantages and features of this invention will become more apparent from the following detailed description of a now preferred embodiment thereof, taken in conjunction with the accompanying drawing wherein FIG. 1 is a highly schematic side elevational view of a mobile track tamping machine adapted to incorporate the invention;

FIG. 2 schematically illustrates metering means according to the present invention;

FIG. 3 illustrates a useful tamping tool with an internal conduit for delivering the liquid bonding medium; and FIG. 4 is a horizontal cross section along line IV—IV of FIG. 3.

Referring now to the drawing and first to FIG. 1, there is shown a generally conventional mobile track tamping machine having frame 4 mounted for mobility on a track consisting of ties 2 and rails 1, 1 fastened to the ties. The track rests on ballast bed 3. Merely by way of illustration, there is shown the type of ballast tamper which comprises two adjacent tamping units each assembled of pairs of vibratory tamping tools 5 reciprocable towards and away from each other in the direction of track elongation for tamping the ballast between the tools of each pair upon reciprocation towards each other, adjacent ones of the tools of adjacent pairs of tools being immersed in the same crib so that two adjacent ties are tamped simultaneously. In addition, surface tamping tools may be mounted on the frame for tamping the ballast at the ends of the ties, such surface tamping tools not being shown to avoid unnecessary crowding of FIG. 1. The tamping tools are mounted in a well known manner on carriers movable vertically on the frame for moving the tamping tools between an upper position out of engagement with the ballast and a lower position wherein the tamping tools are immersed in the ballast for tamping thereof. In fact, the arrangement of the tamping tools forms no part of the present invention which is not limited in this respect and may be practiced with any type of mobile track tamping machine, such machines being well known to those skilled in the art.

According to this invention, tank wagon 6 is coupled to the tamping machine frame for storing a liquid bonding medium, and storage container 8 is arranged on frame 4, flexible conduit or hose 7 being connected between tank 6 and container 8 to supply bonding medium to the container. The bonding medium may be pumped into container 8 or may be fed to it by gravity or in any other suitable manner.

FIG. 2 illustrates the metering and control means 9 (shown within the broken lines) for the flow of the liquid bonding medium from storage container 8 to openings 28 (see FIGS. 3 and 4) at the end of internal conduit 26 in tamping tool 5. As shown in FIG. 2, discharge conduit 10 leads from storage container 8 to output conduit 12 of metering cylinder 13 and to hose 23, a pair of spring-biased check valves 11,11 being mounted on conduit 10 on either side of conduit 12. The metering means for the liquid bonding medium flowing through discharge conduit 10 consists of a cylinder-and-piston device with an adjustable piston stroke, piston 14 moving in metering cylinder 13 whose output conduit 12 is connected to conduit 10 between valves 11. A pressure fluid drive moves piston 14 in response to the vertical movement of the tamping tool carrier, the pressure fluid being hydraulic or pneumatic, and the drive comprising control cylinder 16 and double-acting piston 15 reciprocable therein, piston 15 being coupled to piston 14 for driving the latter. The piston stroke may be adjusted by moving adjustable stop 17 extending into the chamber of control cylinder 16 and adjustable from the outside thereof.

In the illustrated embodiment, the tamping tools are driven hydraulically, for which purpose the machine comprises a hydraulic operating circuit of any known or suitable design. Control or governor 18 is arranged in the hydraulic operating circuit of the machine to control the flow of hydraulic fluid into control cylinder 16 and thus to control the movement of double-acting piston 15. Four-way valve 18 has three operating positions and is spring-returned into its center position. It is responsive to double limit switch means 19 as well as pressure gage 20, i.e. it is operated in response to the vertical movement of the tamping tool carrier and to the tamping pressure prevailing in the hydraulic circuit. Limit switch means 19 is mounted in the path of a sensing element carried by the tamping tool carrier in a manner well known per se. When tamping tool carrier has been vertically lowered to a given immersion depth of the tamping tools in the ballast, the upper limit switch of switch means 19 is tripped by the sensing element to operate control 18 so as to supply hydraulic fluid through conduit 29 into control cylinder 16 whereby piston 15 is moved so as to meter an amount of liquid bonding medium through valve 11 and flexible conduit or hose 23 into internal conduit 26 of tamping tool 5. The metered amount is set by the adjustment of the piston stroke by stop 17, the movement of piston 14 pumping the metered amount of liquid bonding medium through valve 11 into hose 23 to deliver this amount of bonding medium to the ballast. This adjustment makes it possible to adapt the injected amount of bonding medium to all local requirements, while the metering piston is driven in a simple manner in response to the operation of the tamping tools to determine the commencement and termination of the bonding medium injection into the ballast. When the tamping has been completed and the tamping tool carrier is vertically raised to move the tamping tools out of engagement with the ballast, the lower limit switch of switch means 19 is tripped by the sensing element so that control 18 supplies hydraulic fluid through conduit 30 into control cylinder 16 whereby piston 15 is moved in the opposite direction to suck a metered amount of liquid bonding medium from storage container 8 through valve 11 into the chamber of metering cylinder 13, thus setting the metering means for the subsequent operation.

In addition to responding to the vertical movement of the tamping tool carrier for the commencement and termination of the bonding medium delivery, control 18 is also responsive to the tamping pressure so that delivery of bonding medium will commence only in response to a set pressure. For this purpose, pressure gage 20 is mounted in the hydraulic circuit conduit which controls the reciprocation of the tamping tools of each pair of tools. This gage measures the hydraulic pressure in the conduit which, in turn, is a function of the tamping pressure the pair of tools exerts upon the ballast lodged therebetween. The pressure gage is set to deliver a control signal to control 18 when this pressure has reached a predetermined point. This control signal opens a check valve in hydraulic fluid input conduit 21 to permit hydraulic fluid to flow through conduit 30 into control cylinder 16 after operation of limit switch means 19. In this manner, the bonding medium delivery is controlled not only by the immersion depth of the tamping tool but also by the tamping pressure. Since the pressure gage is set to emit a control signal when the pressure indicates an optimal degree of ballast compaction, bonding medium will be delivered at the optimum time. Hydraulic fluid discharge conduit 22 connects control 18 to the hydraulic fluid sump (not shown) of the hydraulic circuit to return hydraulic fluid from cylinder 16 to the sump.

For the sake of simplicity, FIG. 2 illustrates only a single tamping tool 5 although, in a mobile tamping machine such as the type shown in FIG. 1, a plurality of tamping tools usually assembled into tamping units will be provided so that a distributor will be mounted behind switch valve 11, a like plurality of delivery conduits 23 being connected to the distributor to deliver metered bonding medium to each tamping tool. If the liquid bonding medium comprises a plurality of components which are to be combined in situ, i.e. after injection into the ballast, to react chemically and thus to form the bonding medium, a like plurality of metering and control means 9 are arranged in the hydraulic circuit to meter and control the flow of each component into a like plurality of internal conduits arranged side-by-side in each tamping tool. In a very simple manner, for instance, a tube with a vertical dividing wall may be introduced into conduit 26 to provide separate compartments or conduits for feeding the components ejection channels 28. On the other hand, some multiple-component bonding media may be mixed shortly before they are injected into the ballast, in which case the separately metered amounts of the bonding medium components may be delivered to a single distributor which delivers the mixed medium into a single internal conduit 26 in the tamping tool through a single hose 23. It would also be possible to meter the various components of a multiple-component bonding medium from their respective storage containers 8 sequentially to the tamping tool so that the components are mixed in the ballast as one after the other is injected thereinto.

FIGS. 3 and 4 illustrate details of the bonding fluid delivery conduit in tamping tool 5. As shown, the tamping tool is mounted on a tamping tool arm by means of conical connection 24 while delivery hose 23 is detachably connected to the tamping tool by nipple 25. Internal conduit 26 is provided in the interior of the tamping tool to lead from nipple 25 to a pair of ejection channels or openings 28 leading from conduit 26 through tamping tool plate 27.

The illustrated embodiment operates in the following manner.

Liquid bonding medium flows from storage tank 6 into storage container 8 so that the latter remains always full. (If a multiple-component liquid medium is used, each component is, of course, stored separately, as indicated hereinabove, the delivery operation of each component being the same as hereinbelow described in connection with a single-component bonding medium.) After the tamping tool has been lowered into the ballast and the ballast has been sufficiently tamped, as determined by pressure gage 20, metering and control means 9 will deliver a metered amount of liquid bonding medium from storage container 8 to conduit 26 in tamping tool 5. Lowering of the tamping tool into the ballast has tripped limit switch means 19 at a set immersion depth of the tamping tool in the ballast so that control 18 will bring input conduit 21 connected to the hydraulic fluid supply circuit of the machine into communication with conduit 29 leading to the lower chamber of control cylinder 16. At the same time, control 18 will interconnect conduit 30 leading from the upper chamber of the control cylinder with discharge or return conduit 22. A check valve in control 18 will prevent flow of hydraulic fluid from input conduit 21 into conduit 29 until the check valve is opened by a control signal from pressure gage 20, this control signal being emitted when the gaged tamping pressure has reached a set optimum value. At this point, opening of the check valve will permit hydraulic fluid to flow into the lower chamber of control cylinder 16 to lift piston 15 and piston 14, and thus to deliver the metered amount of liquid bonding medium from the upper chamber of metering cylinder 13 through valve 11 into delivery conduit 23. If valve 11 is a flap valve, the pressure of the metered liquid will automatically open the flap to permit the liquid to flow into conduit 23. If it is a multi-way valve, control 18 will actuate the valve so as to permit this flow into conduit 23. In this manner, the commencement of the delivery of a metered amount of liquid bonding medium is accurately controlled in response to the depth of the immersion of the tamping tool in the ballast as well as in response to the tamping pressure. If pressure gage 20 were omitted, this control would be responsive solely to the immersion depth. The delivered bonding medium is ejected through openings 28 into the ballast where it flows over the adjacent pieces of ballast to coat the same and, upon hardening of the bonding medium, to bond them together.

As soon as the reciprocation of the tamping tools has been terminated to stop the tamping operation, the decrease in the tamping pressure causes the control signal from pressure gage 20 to be terminated and the check valve in control 18 to close again. This terminates operation of the metering means. The subsequent upward movement of the tamping tool carrier causes the sensing means on the carrier to trip the lower limit switch of switch means 19 so that control valve 18 will interconnect input conduit 21 with conduit 30 leading to the upper chamber of control cylinder 16 while conduit 29 from the lower chamber of the control cylinder will be in communication with return conduit 22. The check valve is now briefly opened, either manually or automatically, to move pistons 15 and 14 down and thus to suck a metered amount of liquid bonding medium from storage container 8 into the upper chamber of metering cylinder 13 until piston 15 is stopped by stop 17. The adjustment of the stop determines the metered amount of the bonding medium by changing the piston stroke. The metering and control means 9 is now ready to deliver a metered amount of bonding medium during the next tamping operation in the above-described manner.

Obviously, the apparatus of the present invention is not limited to the illustrated type of tamping tool or tamping tool units. By way of example, tamping tools may be used which are vertically immersed in the ballast and tamp the same merely by vibration and without reciprocation in the direction of track elongation. In this case, the delivery of the bonding medium is controlled merely by the immersion depth and without regard to the tamping pressure. Furthermore, various metering means for the liquid bonding medium may be used in connection with single or multiple-component liquid bonding media without departing from the spirit and scope of this invention as defined by the appended claims.

The efficiency of the bonding medium will be increased if the ballast pieces are freed of dirt, such as sand or dust, before they are coated with the bonding medium. Thus, if fines are removed from the surfaces of the ballast pieces during tamping, the ballast pieces will be in better surface contact and the bonding medium will bond them together more effectively. Thus, it will be advantageous to deliver a scavenging medium, such as compressed air, to and through the internal conduit of the tamping tool to eject it through the opening before the commencement of the delivery of the bonding medium to cleanse the ballast. It will be equally useful if the delivery conduits of the bonding medium are cleansed of residual bonding medium after the tamping tool has been removed from the ballast and the delivery of bonding medium has been terminated. This will prevent clogging of the conduits and may be achieved also by delivering the scavenging medium immediately subsequent to the delivery of bonding medium. For this purpose, storage container 31 for a scavenging medium, such as compressed air, is provided in addition to the storage container for the bonding medium. While check valves 11 are closed, two-way slide control valve 33 on conduit 32 is opened to supply the scavenging medium from storage 31 to hose 23. Valve 33 is shown connected to the control circuit for control 18 for timed operation therewith and may include a delay relay automatically permitting a spring to close the valve after a given time interval after the relay has been deactivated.

The sensing means on the vertically movable tamping tool carrier, in cooperation with limit switch means 19, prevents ejection of bonding medium in any vertical position of the tamping tool, except at a predetermined immersion depth. This sensing means may also be used to connect switch valve 11 briefly with the supply of scavenging medium after the tamping tool has been lifted out of engagement with the ballast to cleanse the delivery conduits.

As shown in FIG. 3, the tamping tool advantageously has a pressure part for contact with the ballast and a pressure plate for exerting tamping pressure on the ballast, and internal conduit 26 passes through the pressure part and the openings 28 are in the pressure plate. Since the tamping tool is subjected to considerable flexure forces during tamping, this arrangement of the internal conduit will avoid concentrations of tensile forces and possible fracture of the tool.

Useful two-component bonding media include 1–2% ammonia solutions and a butadien-styrene copolymer. Other bonding media are, for instance, a copolymer of equal parts of n-butyl acrylate, vinyl acetate and vinyl chloride with an aqueous dispersion of polyisobutylene or a copolymer of vinyl propionate and vinyl chloride.

What is claimed is:

1. An apparatus for bonding together pieces of tamped ballast forming the bed of a track consisting of ties and rails fastened to the ties, comprising 1. a mobile track tamping machine having a frame mounted for mobility on the track,
2. a ballast tamping tool having an internal conduit ending in an opening for ejecting a liquid passing through the conduit under pressure,
3. a vertically movable carrier for the tamping tool mounted on the frame for moving the tamping tool between an upper position out of engagement with the ballast and a lower position wherein the tamping tool is immersed in the ballast for tamping thereof,
4. a storage container for a liquid bonding medium,
5. conduit means between the storage container and the internal conduit of the ballast tamping tool for delivering the liquid bonding medium from the container to the internal conduit, 6. a metering means for the liquid bonding medium arranged in the conduit means,
   a. the metering means consisting of a cylinder-and-piston device with an adjustable piston stroke, and
7. a pressure fluid operated drive for moving the piston of the device in response to the vertical movement of the tamping tool carrier.

2. The apparatus of claim 1, further comprising a switch valve in the conduit means between the metering means and the internal conduit of the tamping tool, and a storage container for a scavenging medium, the switch valve selectively connecting the internal conduit of the tamping tool to the metering means and to the storage container for the scavenging medium.

3. The apparatus of claim 1, further comprising sensing means for sensing the vertical position of the tamping tool carrier, the sensing means operating the valve to commence delivery of the bonding medium when the tamping tool carrier is in the lower position and terminating the delivery when the carrier is in the upper position, and the sensing means selectively and briefly connecting the internal conduit of the tamping tool to the storage container for the scavenging medium in the upper position.

4. The apparatus of claim 1, comprising a plurality of the ballast tamping tools assembled into a tamping unit, the tamping unit comprising pairs of said tamping tool reciprocable towards and away from each other in the direction of the track elongation for tamping the ballast between the tools of each pair upon reciprocation towards each other, and a hydraulic supply circuit for reciprocating the tools, a hydraulic pressure gage in the supply circuit, and means operatively connecting the pressure gage and the metering means for commencing delivery of the liquid bonding medium in response to a set limit value of the hydraulic pressure in the circuit.

5. The apparatus of claim 1, wherein the tamping tool has a pressure part for contact with the ballast and a pressure plate for exerting tamping pressure on the ballast, the internal conduit passing through the pressure part and the opening being in the pressure plate.

* * * * *